US009573660B2

(12) United States Patent
Mol

(10) Patent No.: US 9,573,660 B2
(45) Date of Patent: Feb. 21, 2017

(54) TRACTION SYSTEM FOR OPERATING LINES OF A VESSEL

(71) Applicant: Michiel Giovanni Mol, Rotterdam (NL)

(72) Inventor: Michiel Giovanni Mol, Rotterdam (NL)

(73) Assignee: SBM SCHIEDAM B.V., Schiedam (NL)

( * ) Notice: Subject to any disclaimer, the term of this patent is extended or adjusted under 35 U.S.C. 154(b) by 220 days.

(21) Appl. No.: 14/376,853

(22) PCT Filed: Feb. 6, 2013

(86) PCT No.: PCT/EP2013/052344

§ 371 (c)(1),
(2) Date: Aug. 6, 2014

(87) PCT Pub. No.: WO2013/117597

PCT Pub. Date: Aug. 15, 2013

(65) Prior Publication Data

US 2015/0000581 A1 Jan. 1, 2015

(30) Foreign Application Priority Data

Feb. 6, 2012 (EP) ..... 12154083

(51) Int. Cl.
*B63B 21/50* (2006.01)
*B63B 21/04* (2006.01)
(Continued)

(52) U.S. Cl.
CPC ..... *B63B 21/04* (2013.01); *B63B 21/16* (2013.01); *B63B 21/50* (2013.01); *B66D 1/60* (2013.01)

(58) Field of Classification Search
CPC ..... B63B 21/50; B63B 21/04; B63B 21/16
See application file for complete search history.

(56) References Cited

U.S. PATENT DOCUMENTS 4,958,805 A 9/1990 Willamsson
2003/0159638 A1* 8/2003 Lay ..... B63B 21/04 114/293

(Continued)

FOREIGN PATENT DOCUMENTS

FR 2 385 584 10/1978
JP S60 90089 6/1985

(Continued)

OTHER PUBLICATIONS

International Search Report dated May 24, 2013, corresponding to PCT/EP2013/052344.

*Primary Examiner* — Edwin Swinehart
(74) *Attorney, Agent, or Firm* — Young & Thompson

(57) ABSTRACT

A traction system (11; 60) for operating lines (18), in particular mooring lines and/or riser lines, of a vessel (1), includes at least two work stations (26) distributed along at least two sides of the vessel (1) and engaged by respective operating lines (18). The traction system includes a main traction device (14; 15, 17; 15A, 17) and a transmission device (36) having a duty line (28) connected to the main traction device and at least one guide member (24) for selectively routing the duty line (18) to each work station (26) for attachment to a respective operating line (18). A line storing space (22; 42, 44) is provided for storing parts of the duty line and/or hauled in moorings lines; the main traction device, the transmission device and the line storing space are placed together at or near a side of the floating production unit.

20 Claims, 11 Drawing Sheets

(51) Int. Cl.
*B63B 21/16* (2006.01)
*B66D 1/60* (2006.01)

(56) References Cited

U.S. PATENT DOCUMENTS

2012/0266800 A1* 10/2012 Edelson ..... B63B 21/50
114/230.2
2014/0286711 A1* 9/2014 Busson ..... B63B 21/50
405/224

FOREIGN PATENT DOCUMENTS

WO 2004/050470 6/2004
WO 2008/046874 4/2008
WO 2010/084420 7/2010

* cited by examiner

TRACTION SYSTEM FOR OPERATING LINES OF A VESSEL

FIELD

The present invention relates to a traction system for operating lines of a vessel. Additionally, the present invention relates to a method for such a traction system.

BACKGROUND OF THE INVENTION

From the prior art spread mooring systems for vessels such as floating storage offloading (FSO) or floating production storage offloading (FPSO) vessels or in general, floating offshore units are known.

WO2010084420 discloses a method and system for tensioning a function line in particular a mooring line of a FPSO vessel. Such a traction method for an operating line, in particular a mooring line, includes the steps of: attaching an end chain portion of the operating line to a socket of a main cable running through a sheave at a work station; reeling in the main cable, using a winch, to bring the socket of the main cable up to the sheave; locking the operating line with a chain stopper; slackening the main cable and moving the sheave closer to the chain stopper to reduce pull on the main cable; reeling in the main cable to run the socket of the main cable through the sheave,—once the socket of the main cable has run through the sheave, releasing the operating line from the chain stopper, and reeling in, by means of the winch, the main cable and the operating line connected to it.

WO2004050470 discloses a mooring windlass/winch system that provides a horizontal shaft type windlass wildcat integral with a wire rope type winch mounted above and behind the windlass wildcat. The combined windlass/winch is mounted on a circular foundation that permits the windlass to rotate in the horizontal plane about the centerline of the windlass chain locker. The ability to orient the windlass and winch in the horizontal plane allows a single windlass to serve a number of mooring chains.

Further as shown in FIG. 1, a mooring system 10 is known from the prior art that comprises a (hydraulic) power unit 12, a chain handler 14 and a number of turn-down sheaves 16. The turn-down sheaves 16 are arranged at a side of the vessel 1 for example an FPSO. The power unit 12 is arranged to power the chain handler 14, that is capable of pulling or paying out the individual mooring legs or chains 18. The mooring legs 18 run from the chain handler 14 over each of the turn-down sheaves 16. The chain handler 14 is at a fixed position towards the centerline 2 of the FPSO and away from the turn-down sheaves 16 in such a way that each mooring leg is under a different angle β with the chain handler. Due to the different angles, pulling characteristics on each mooring leg 18 are different, which require a relatively wide power range for the chain handler 14.

It is an object of the invention to overcome the disadvantages from the prior art.

SUMMARY OF THE INVENTION

The object is achieved by the traction system as defined in claim 1. Advantageous embodiments are further defined by the dependent claims.

BRIEF DESCRIPTION OF DRAWINGS

The invention will be explained in more detail below with reference to drawings in which illustrative embodiments of the invention are shown. It will be appreciated by the person skilled in the art that other alternative and equivalent embodiments of the invention can be conceived and reduced to practice without departing from the true spirit of the invention, the scope of the invention being limited only by the appended claims.

DETAILED DESCRIPTION OF EMBODIMENTS

Figure 1:
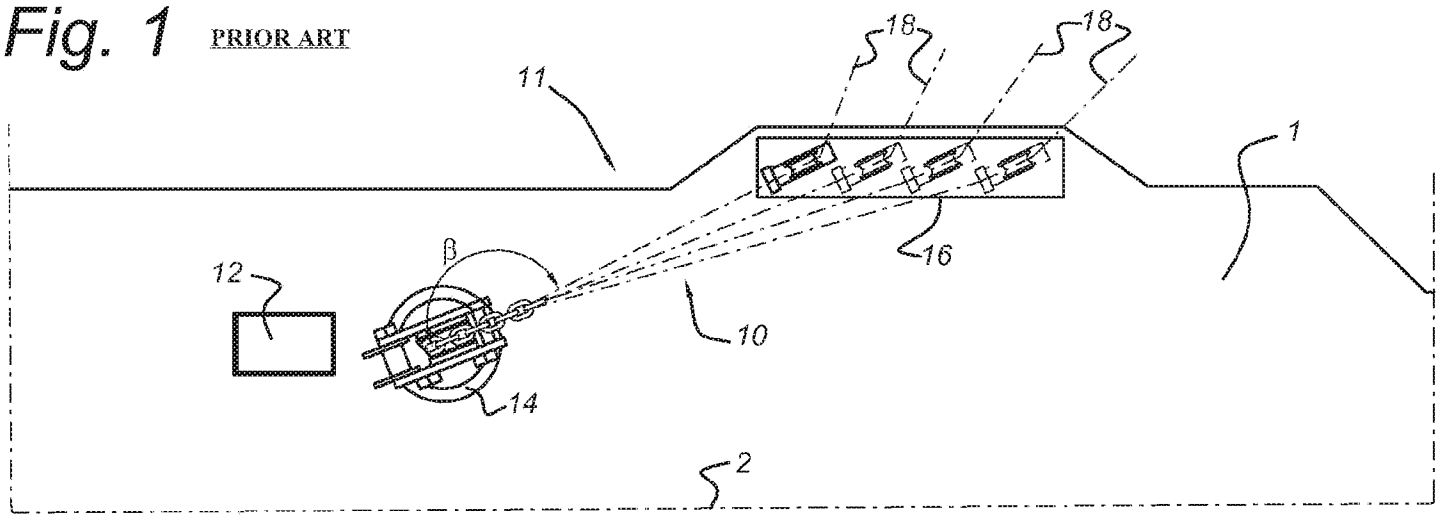
Fig. 1 PRIOR ART
FIG. 1 shows a layout of a deck portion of a FPSO vessel with a traction system according to the prior art.

The present invention relates to a traction system for a vessel. Such a vessel may be a floating production storage offloading unit (FPSO) but can also relate to a floating offshore unit or a floating production unit (FPU), or a floating storage offloading unit (FSO). Without limitation of the scope of the invention, floating offshore unit may also comprise drilling vessels, semi-subs, SPARS, FSRU's, Otec systems, floating power plants, floating hotels.

A spread moored FPSO deck space is a congested area with all kinds of processing units. Typically there is no space for winches and tensioned cables connected over the deck via sheaves to mooring lines and production lines (like risers) for hauling in or paying out operations.

A floating offshore unit such as an FPSO is provided with at least one, preferably four traction systems according the invention. The FPSO is for example provided with four mooring tensioning systems (or traction systems) which are located on one of the four mooring porches of the FPSO. There will be one porch on each corner of the vessel: Port-Aft, Port-Fore, Starboard-aft, Starboard-Fore. The mooring tensioning or traction systems are subjected to the FPSO's motions and to the environmental conditions while in operation.

Also, during the mooring operation of the FPSO, the traction system provides the tensioning of the mooring legs by connecting with the external mooring leg chains. Typically, each mooring leg chain is coupled to a duty line such as an installation chain that is arranged within the traction system. Each mooring leg runs from the sea level up through a fairlead to the deck level of the vessel. Next, the traction system tensions the mooring leg chain and brings it into a fixed position on the vessel's side. Subsequently, the duty line is repositioned to haul-in and tension a next mooring leg chain.

Therefore the FPSO is provided with a traction system which comprises a locker space for storing parts of the duty line and/or hauled in moorings lines, a main traction or tensioning device, a transmission device which are all are placed together at or near a side of the floating production unit.

It is preferred that the main traction device is placed between the locker space and the workstation to which it is connected in operation and that the main traction device and/or the guide member is moveable over a track placed along a side of the vessel. The traction system is movable over rails or a track over a workstation that comprises at least two fairleads each capable of receiving and holding a mooring line. Preferably, the locker space is an extension at the side of floating production vessel. Further the main traction device, the workstation and the locker space can be combined in one module to facilitate a quick integration of it into the floating production unit.

In an embodiment, the module of the traction system is arranged to be mounted on and fixed to a vessel's deck. Advantageously, the module can be prefabricated after completion positioned and mounted on the vessel.

Now with reference to the FIGS. 3-14 components of the traction system will be discussed in detail.

Figure 2:
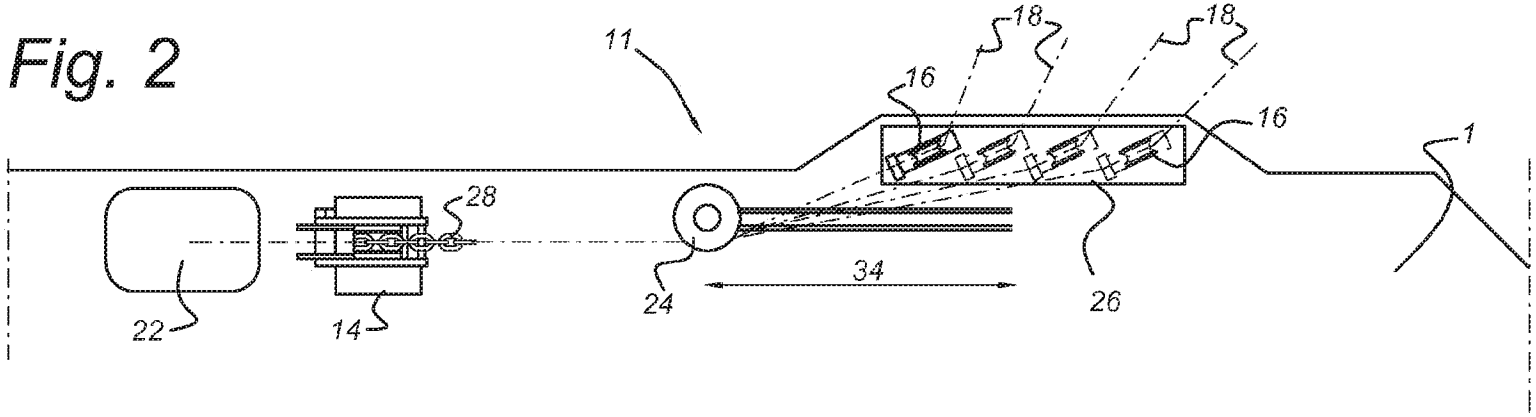
FIG. 2 shows a layout of a deck portion of a FPSO vessel with a traction system according to an embodiment of the invention.

FIG. 2 shows a top view of a traction system 11 on a vessel deck 1, which traction system comprises a chain locker space 22, a traction device 14, a guiding element 24, a workstation 26 with four turn-down sheaves 16. The chain locker space, traction device, guide sheave guiding element are grouped together at a aside of the vessel 1, close to the workstation 26. Each turn-down sheave 16 is configured to guide the mooring leg chain 18 from an upper opening end 40 of a fairlead 38 (not shown) to the traction device 14. Over the turn-down sheaves 16 the mooring leg chains each can connect to a duty line 28 (an installation chain). The duty line 28 is extending along the guide sheave guiding element 24 and the traction device 14 into the chain locker space 22. In an embodiment, the traction device 14 is a chain tensioner 15, as will be described in more detail below.

The guiding element 24 is a circular element that allows guiding the duty line 28 over each of the turn-down sheaves 16, each time under a respective directional angle β.

The traction device 14 further comprises a rail track 30 for a skidding unit 32. The rail track 30 runs substantially parallel to the sheaves 16 in the workstation 16. The guide sheave guiding element 24 is arranged on the skidding unit 32 and can move 34 along the track to be positioned relative to a selected turn-down sheave 16. In this manner, the directional angle for each mooring leg chain on its respective turn-down sheave is substantially the same.

Figure 3:
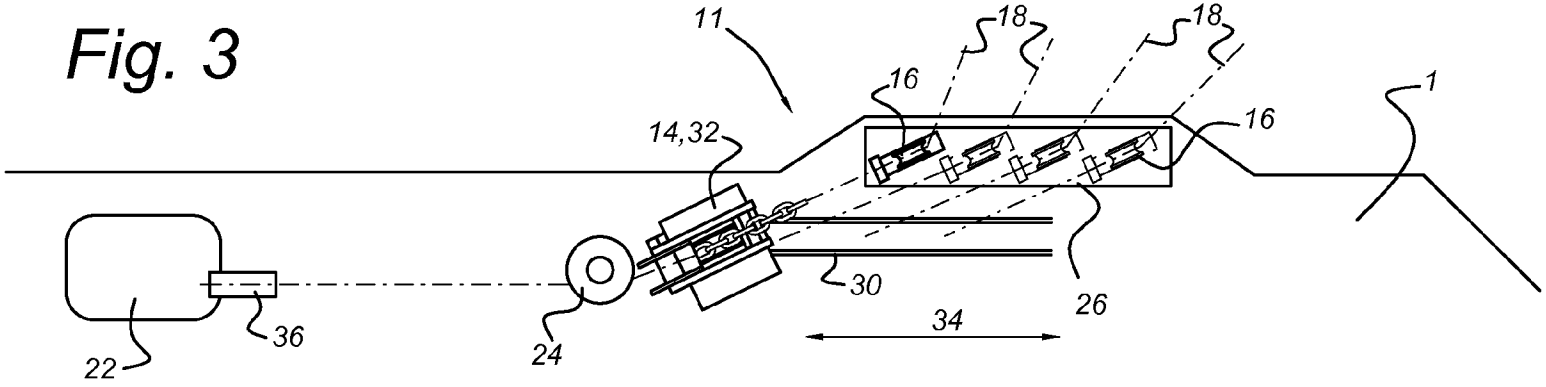
FIG. 3 shows a layout of a deck portion of a FPSO vessel with a traction system according to an embodiment of the invention.

FIG. 3 shows a top view of a traction system 11 according to an embodiment. The traction system comprises a chain locker space 22, a traction device 14, a guiding element 24, a rail track 30, a skidding unit 32 and a workstation 26 with for example four turn-down sheaves 16. The chain locker space, traction device, guide sheave guiding element are grouped together at a aside of the FPSO, close to the workstation 26. The rail track 30 runs substantially parallel to the sheaves 16 in the workstation 26. The traction device 14 is arranged on the skidding unit 32 and can be moved 34 along the track to be positioned in a relative same position and orientation with respect to a selected turn-down sheave. For each selected turn-down sheave, the directional angle of the mooring leg chain is substantially the same.

At the side of the chain locker space 22, the traction system 11 additionally comprises a transmission device 36 for transmitting the duty line or chain 18; 28 to and from the chain locker space 22. In an embodiment, the transmission device 36 may be a motorized chain wheel, which also provides the option to maintain a pre-tension on the chain 18 between the motorized chain wheel 36 and the traction device 14.

Figure 4:
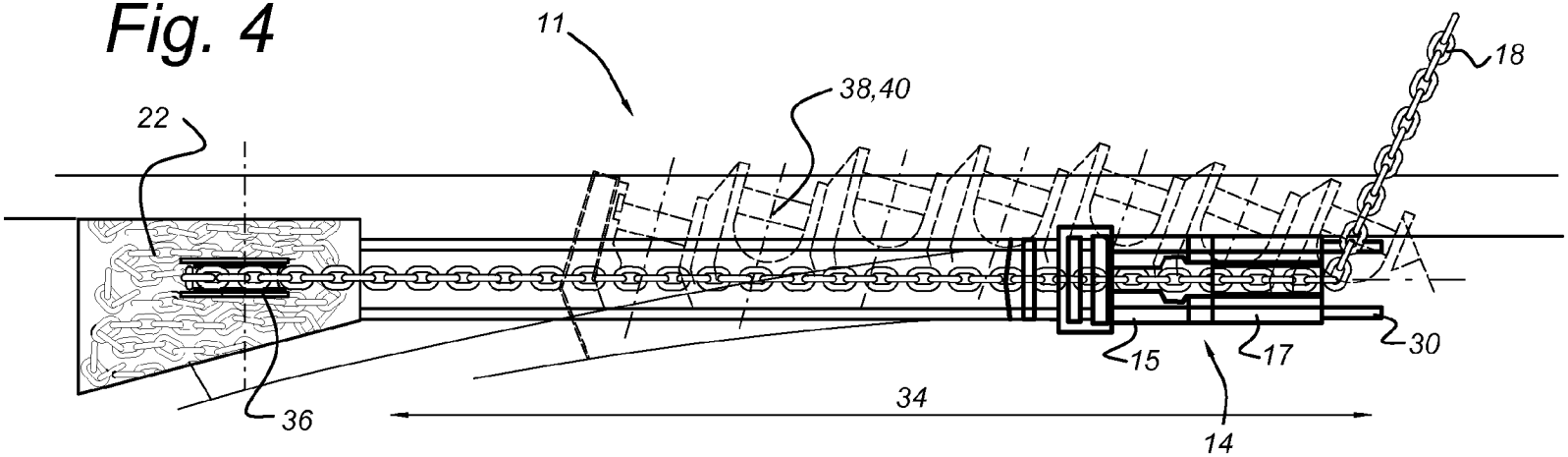
FIG. 4 shows a top view of a traction system according to an embodiment comprising a chain jack skid that is moveable above fairleads.
Figure 5:
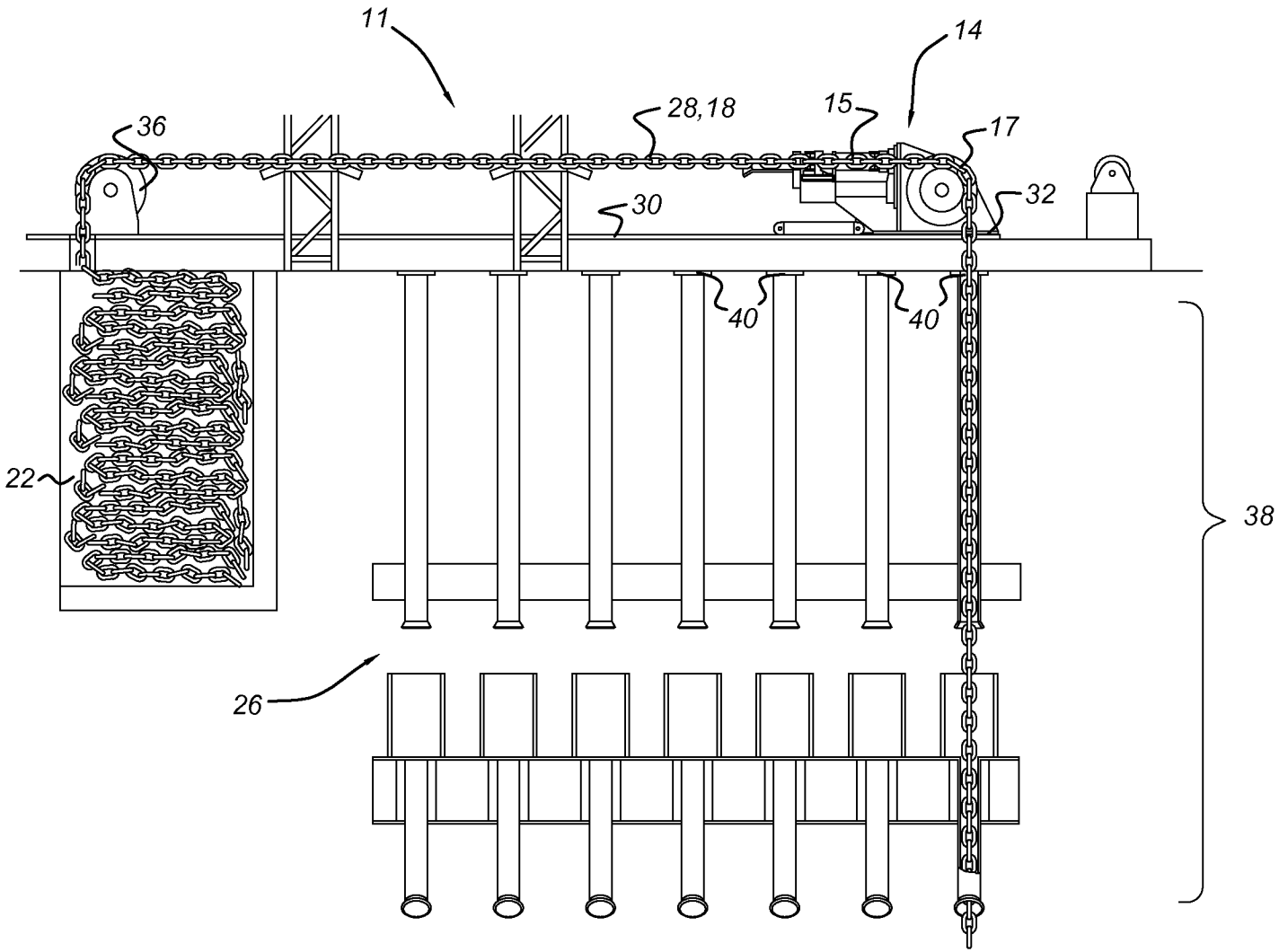
FIG. 5 shows a side view cross section of a traction system according to an embodiment comprising a chain jack skid that is moveable above fairleads.

FIGS. 4 and 5 show a top view and a side view respectively of a traction system according to an embodiment. The traction system comprises a chain locker space 22, a traction device 14, a guiding element 24, a rail track 30, a skidding unit 32, a transmission device 36 and a workstation 26 with for example six fairleads 38. In this embodiment, the rail track 30 runs parallel to and above the upper end openings 40 of the fairleads 38. In stead of using dedicated turn-down sheaves, the traction device 14 is an arrangement of a chain tensioner 15 and a non-driven chain wheel 17 as chain guiding element, which arrangement is mounted on the skidding unit 32 and can be moved 34 along the skidding unit's rail track 30. The traction device 14 is configured to be positioned above a selected fairlead 38 such that the non-driven chain wheel 17 guides the chain 18 from the chain tensioner 15 into the upper end opening 40 of the selected fairlead 38.

At the side of the chain locker space 22 the traction system additionally comprises the transmission device 36 for transmitting the duty line or chain to and from the chain locker space 22. In an embodiment, the transmission device may be a motorized chain wheel 36, which also provides the option to maintain a pre-tension between the motorized chain wheel 36 and the traction device 14.

In this embodiment, the chain locker space 22, the motorized chain wheel 36, the chain tensioner 15 and the fairleads upper end openings 40 are advantageously in-line with each other which reduces lateral forces on the traction system.

FIG. 5 shows the side view of a general arrangement of traction system (chain tensioning system) according to the invention. In this embodiment, the traction system comprises a chain jack skid 15, 32 that is moveable 34 above fairleads 38. It also shows the position for the motorized chain wheel 36 when over-boarding chain 18 from the chain locker space 22.

Figure 6:
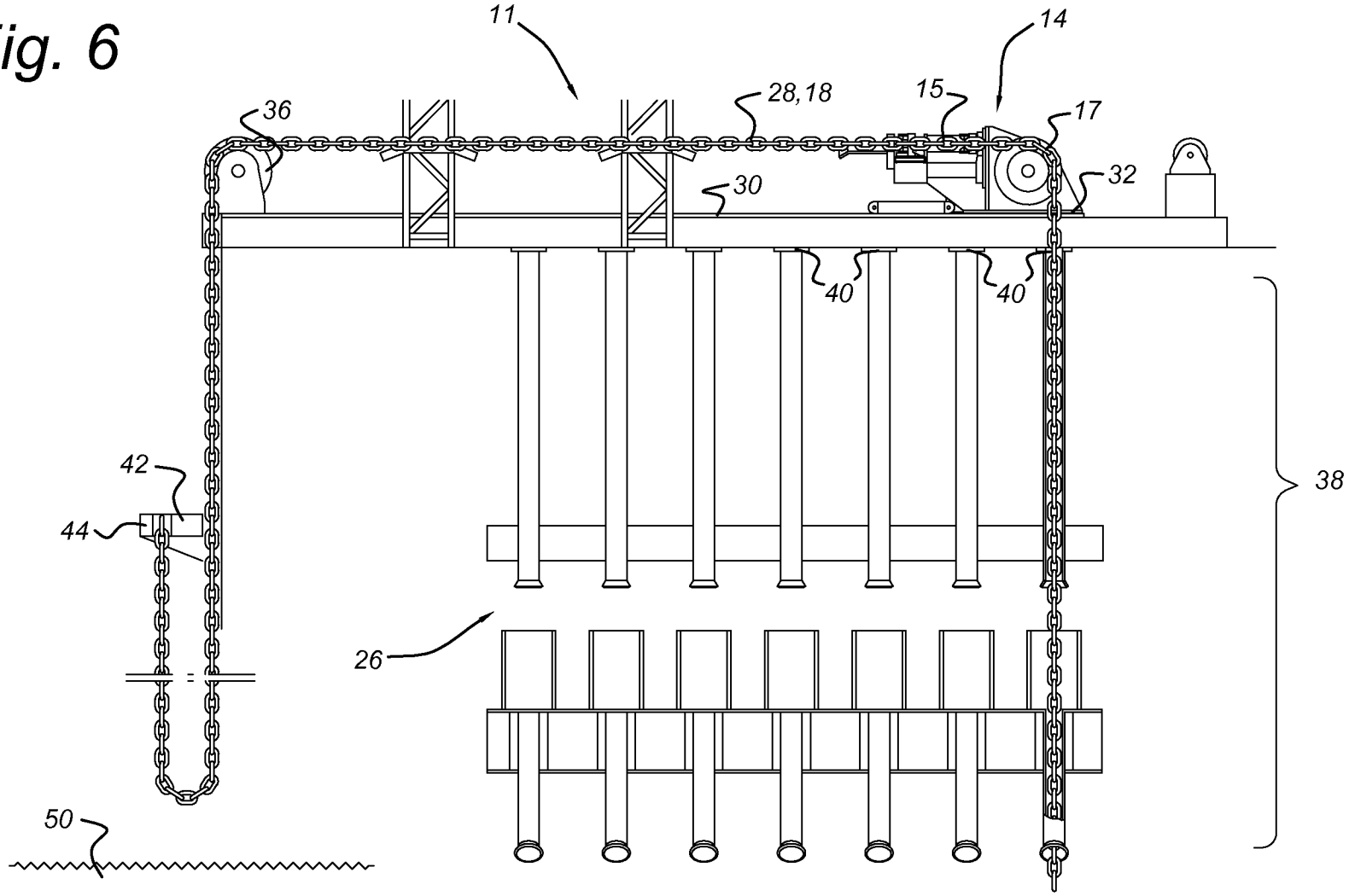
FIG. 6 shows a side view cross section of a traction system according to a further embodiment.

FIG. 6 shows a side view of the traction system of FIG. 6 according to a further embodiment.

In this embodiment the traction system alternatively or additionally comprises a balcony 42 that is arranged at an outer end 23 of the traction system (adjacent to the chain locker 22 if present) in a direction in-line with the rail track 30. The balcony 42 is located outside of the vessel's hull above water 50.

The rail track 30 is extended over the chain locker 22 and over at least a part of the balcony 42. The motorized chain wheel 36 is moveably mounted on the rail track 30 to be positioned over the at least part of the balcony 42. The balcony is provided with means 44 for attaching to an end of the chain 18 and for hanging off the attached chain in one or more loops thus configuring the balcony for storing the chain. In this manner, the chain 18 can hang-off from the balcony above or into the water.

By storing the chain on the balcony, the balcony is thus equivalent to a chain locker space. In an embodiment, the chain locker space can be omitted and replaced by the balcony alone.

Figure 7:
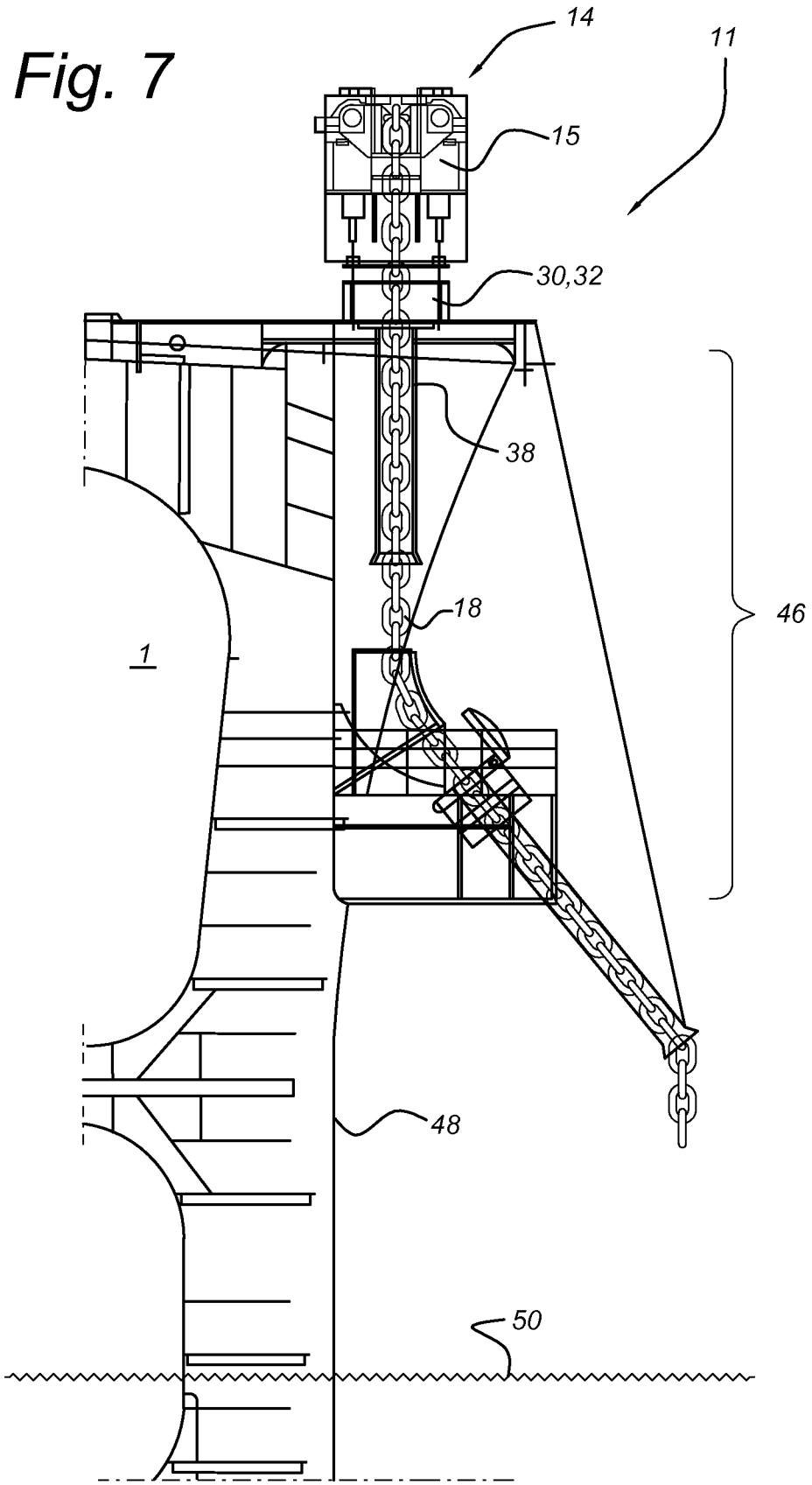
FIG. 7 shows a front view cross section of a traction system according to an embodiment comprising a module having a chain jack skid and fairleads combined.

FIG. 7 shows a cross-section of the traction system 11 with a chain 18 running from the chain tensioner 15 through one of the fairleads 38. In an embodiment, the chain jack skid 15 and fairleads 38 are combined in a module 46 attached to the vessel's hull 48.

Figure 8:
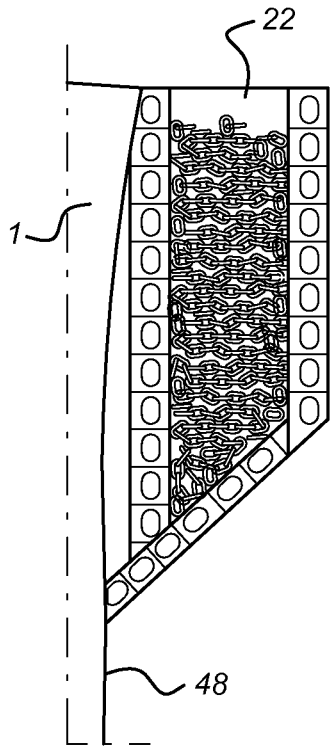
FIG. 8 shows a cross-section of an external chain locker protruding from a side of a vessel.

FIG. 8 shows a cross-section of a chain locker 22 external to the vessel's hull 48.

Figure 9:
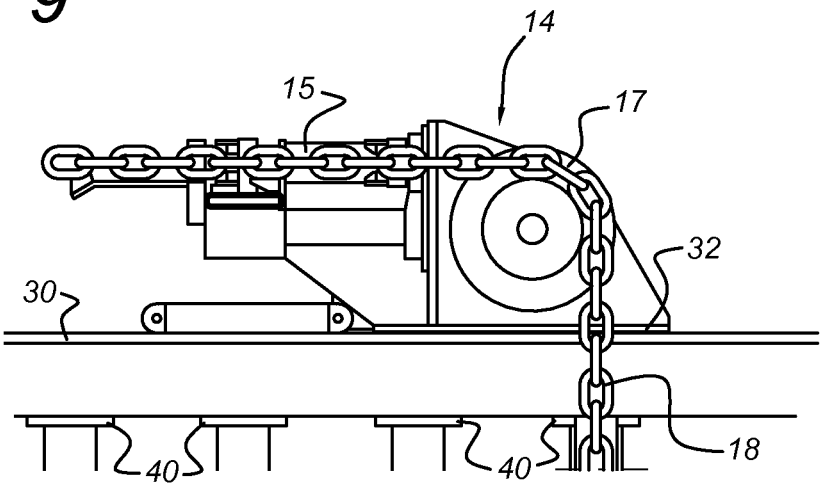
FIG. 9 shows a side-view of horizontal acting chain jack skid system.
Figure 10:
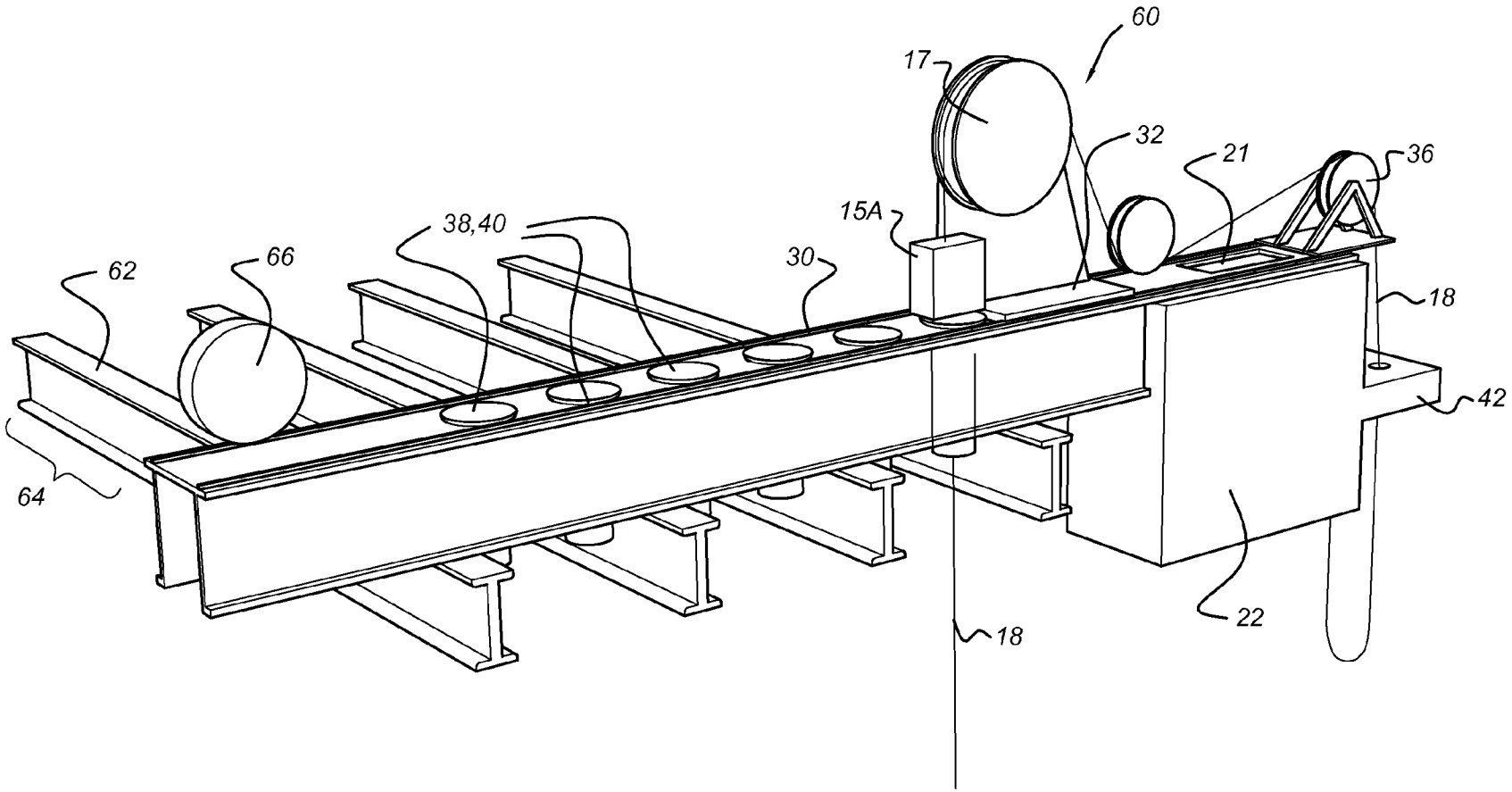
FIG. 10 shows a traction system according to an embodiment of the invention in a perspective view.
Figure 11:
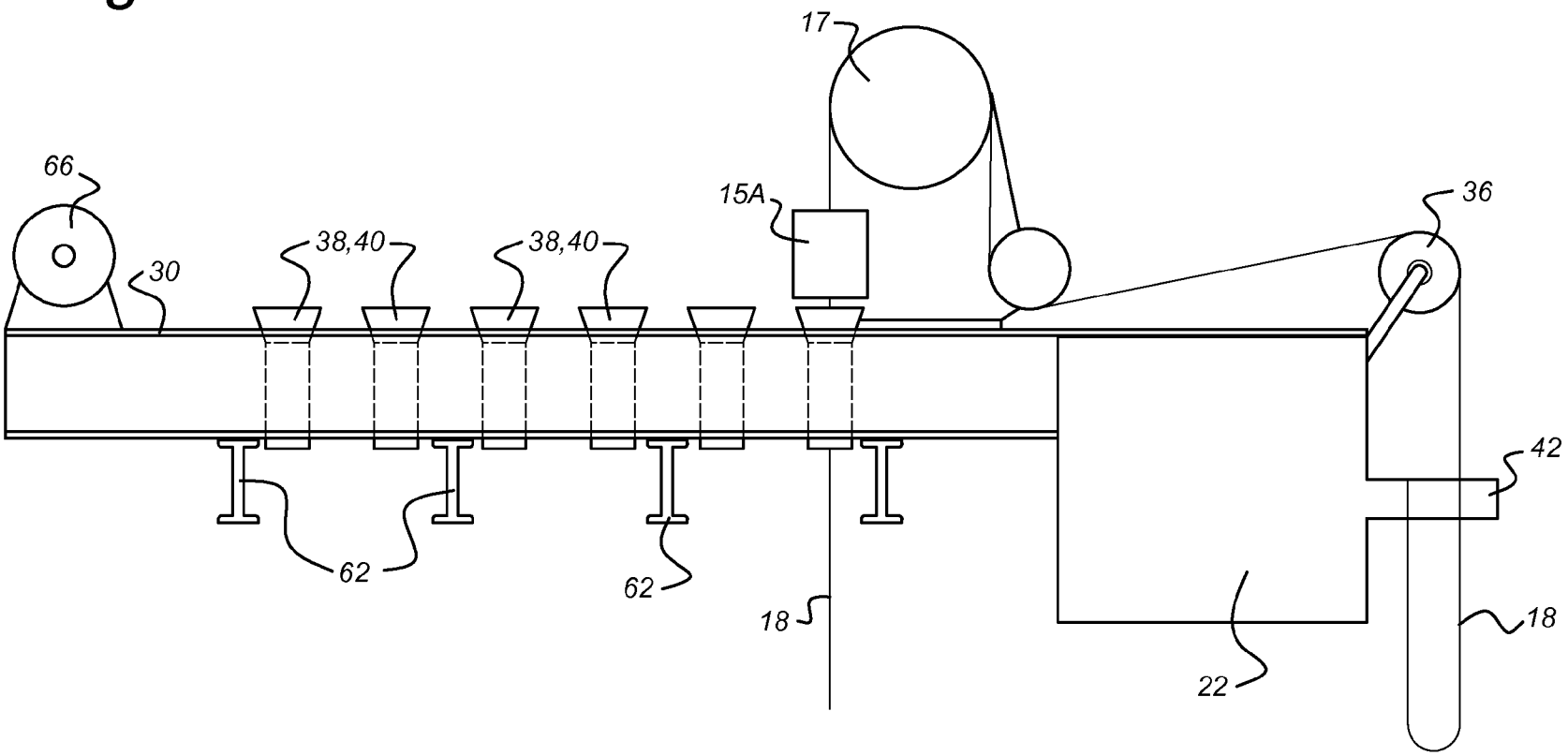
FIG. 11 shows a traction system according to an embodiment of the invention in a side view.

FIG. 9 shows a schematic side view of the arrangement of the chain tensioner 15 and the non-drive chain wheel 17 on a skidding unit 32 on the rail track 30.

The skidding unit 32 allows to position the arrangement 14; 15, 17 relative to a selected fairlead 38. The chain tensioner 15 is arranged as an horizontally acting chain jack, which at the sea-going end is coupled to the non-driven chain wheel 17. The chain wheel 17 guides the chain 18 into the fairlead 38 over which the chain wheel 17 is positioned.

FIGS. 10-13 show a traction system according to an embodiment of the invention in a perspective view, side view, cross-sectional view and top view, respectively.

In this embodiment, the traction system 60 is a modular construction that is mounted at a side of the vessel 1 over the workstation 26. The modular construction 60 comprises a chain locker space 22, a traction device 14, a guiding element 24, a rail track 30, a skidding unit 32, a transmission device 36 and a plurality of support beams 62. Optionally, the chain locker 22 comprises or is replaced by a hang-off balcony 42 as described above in more detail.

By means of the modular construction 60, the traction system can be prefabricated and mounted in completed form on a vessel's deck near the workstation 26 handling the mooring leg chains 18. Moreover, by positioning the modular construction 60 above the fairleads 38 the area on the vessel 1 taken up by the traction system can be minimized.

In the modular construction 60 the plurality of support beams 62 are arranged parallel to each other separated by intermediate spaces. The rail track 30 is mounted on the parallel support beams 62 that run perpendicular to the length of the rail track. Further the support beams 62 are arranged to extend with their free ends 64 on one side of the rail track. In between the rails of the rail track 30 openings 40 are arranged for the fairleads 38 in the workstation 26. At one end of the rail track 30 the chain locker 22 is located, with the rail track 30 extending over the top of the chain locker 22. In case a hang-off balcony 42 is mounted on the modular construction 60, the rail track 30 is configured to extend over at least a part of the balcony area. On the rail track 30 a motorized chain wheel 36 is positioned above either the chain locker 22 opening 23 or the balcony area 42. Preferably, the motorized chain wheel 36 is mounted on an additional skidding unit that can be moved along the rail track 30.

In this embodiment, the traction device 14 can be either the arrangement of a horizontally acting chain tensioner 15 and the non-driven chain wheel 17 as chain guiding element as described above with reference to FIGS. 4-6. Alternatively, the traction device 14 comprises a combination of a vertically acting chain tensioner 15A and non-driven chain wheel 17 as shown here in FIGS. 10-13.

In a further embodiment, the traction system comprises an auxiliary winch 66 at the end of the rail track 30 opposite the motorized chain wheel 36. The functions of the auxiliary winch 66 are described in more detail below.

Figure 12:
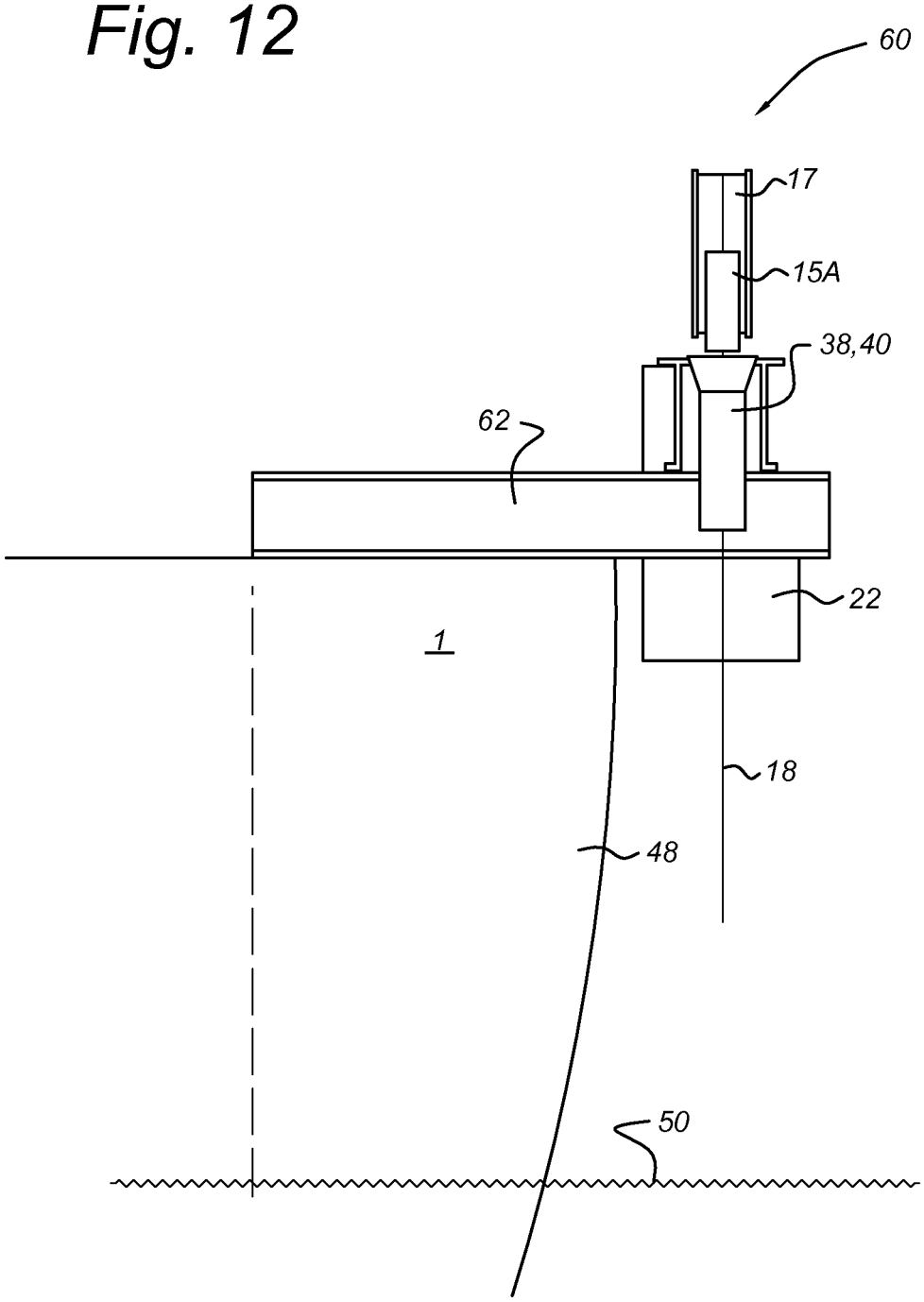
FIG. 12 shows a traction system according to an embodiment of the invention in a cross-sectional view.
Figure 13:
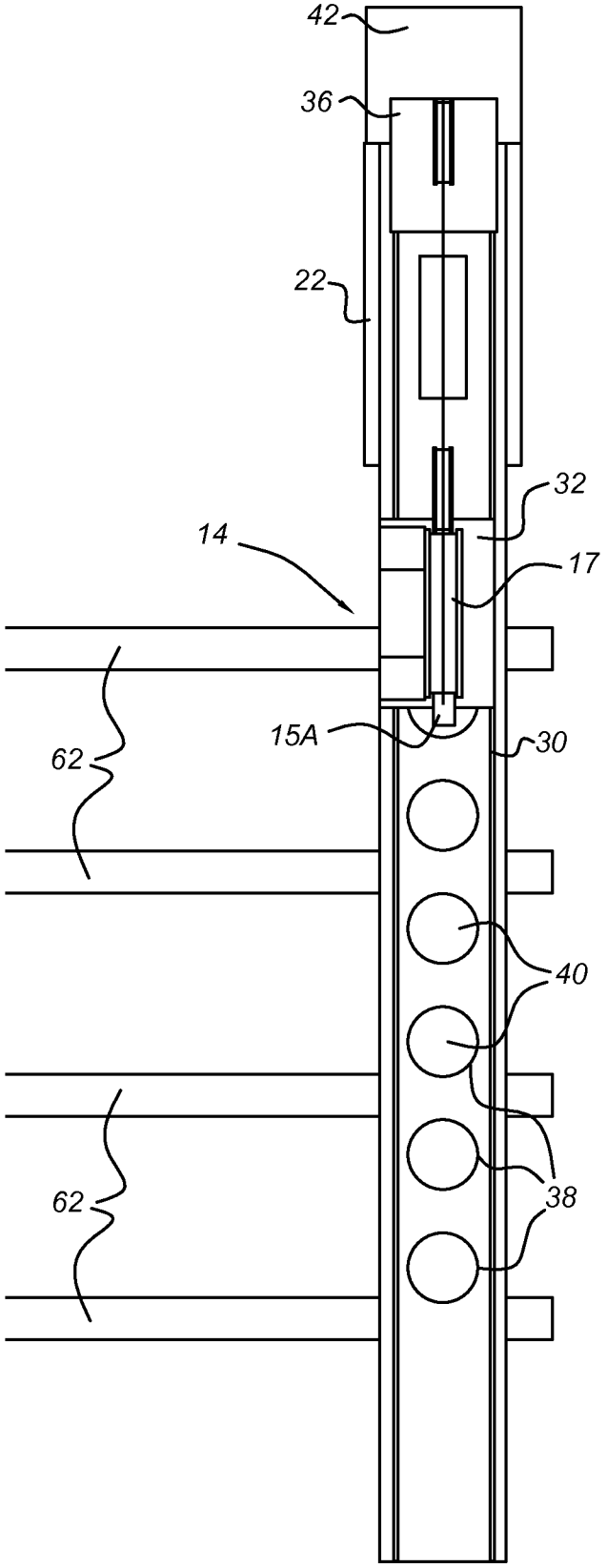
FIG. 13 shows a traction system according to an embodiment of the invention in a top view.

FIGS. 12 and 13 show a cross-sectional view and top view of the traction system 60, in which the free ends 64 of the support beams 62 are mounted to a vessel's deck 1, for example by welding. The rail track 30 holding the traction device 14 and chain wheels 17, 36, and the chain locker 22 and/or hang-off balcony 42 are extending outside the vessel's hull 48 above water 50.

Figure 14:
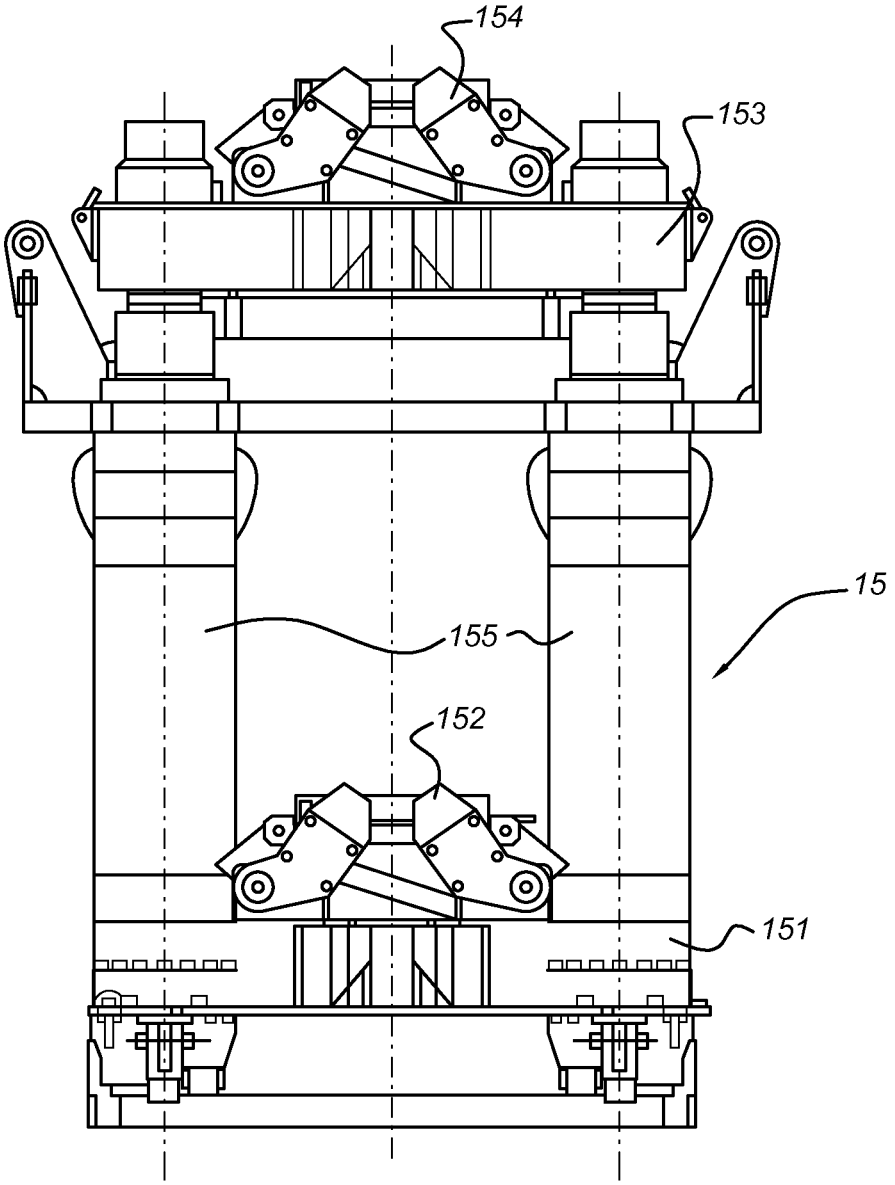
FIG. 14 shows a chain jack system for the traction system according the invention.

FIG. 14 shows a side view of a chain jack skid system 15. The chain jack skid system 15 comprises a chain jack base frame 151 with a lower ratchet 152 and a lifting frame 153 with an upper ratchet 154. By means of parallel hydraulic actuators 155 that couple the base frame 151 with the lifting frame 153, the lifting frame can move relative to the base frame. By the movement and coordinated opening and closing of the lower and upper ratchets 152, 154 a chain (not shown) can be pulled or paid out by the chain jack skid system.

Below, a further description of components of the traction system is given.

Components

Hydraulic Power Units

Provided on the FPSO are also two electric powered hydraulic power units (HPU's) to operate the equipment of the complete tensioning systems. After the installation period, when the tensioning systems are not operated any more, the HPU's can be used to supply power to other equipment like hose reels. Therefore, these operations are not simultaneous.

During the installation period, the power consumers comprise of the 4 mooring tensioning systems located Aft & Fore, PS & SB side on the vessel, that are controlled by their own local control panels.

One HPU will be located forward of the FPSO for operation of forward PS and SB systems, and the other HPU will be located aft of the FPSO for operation of aft PS and—SB systems.

The maximum distance between HPU and consumers is 90 m. The consumers within each mooring tensioning system are (as a minimum): chain tensioner, motorized chain wheel, skidding system and auxiliary winch.

Three separate mooring tensioning operating cases are distinguished for each HPU. Each HPU operates 1 out of 2 connected chain tensioner systems at a time. All motions are enabled to be operated at their maximum specified loads and speeds:

- Chain tensioning operations: dumping chain into the chain locker, operating the chain tensioner and the motorized chain wheel and the skidding unit (while positioning the motorized chain wheel for chain spreading)
- Relocation operations: operating the skidding unit to relocate the (non-operating) chain tensioner.
- Chain overboarding from the locker: operating the auxiliary winch, the motorized chain wheel and the skidding unit for moving the motorized chain wheel.

Chain Tensioner

The chain tensioner (traction) system is designed to handle and tension the mooring chains.

The tensioner stroke is preferable horizontal but can also be vertical. Via a non-driven chain wheel (integrated in the chain tensioner skid), the chain will be lowered vertical.

The chain tensioner skid is used during the initial mooring chain installation and (re-)tensioning operations. The chain tensioner is capable of pulling-in and paying-out a loaded chain up to the stall pull rating. The chain tensioner lifts two chain links per cylinder cycle. The upper and lower ratchets hold only the links that are in a "horizontal" orientation, the vertical links can slide through.

The chain tensioner components are mounted onto a skid that runs over a rail. The rail is (preferably) welded onto the foundation top flange.

The chain tensioner is movable by a skidding unit, typically to be relocated from one mooring leg to the next one. Due to the preferred horizontal orientation of the chain tensioner, sufficient guides shall be integrated in the chain tensioner, in line with all ratchet entries, to properly guide the chain into the ratchets.

The chain is guided from vertical to horizontal direction via the non-driven chain wheel.

FIG. 14 shows the jacking cylinders, the lifting frame and chain ratchets. The required minimum effective cylinder stroke of the chain tensioner system is for example two chain links. The jack's stroke includes an additional to ensure that the opening chain ratchets are able to close and engage on the proper link. The hydraulic system distributes the load equally between the two jacking cylinders.

Since the jacking cylinders are preferably positioned horizontally, they are designed to take lateral (vertical) loadings from dead weights of chain catenary and upper ratchet, also when induced at full extension of the cylinders. The chain tensioner contains a flow control device to be used by the operator to control the chain pull-in speed and the direction of the cylinder stroke.

A lifting frame is mounted at the ends of the cylinder rods and is designed to support the upper ratchet. It is possible to take the chain out of the lifting frame (upwards) without cutting the chain.

The horizontal chain tensioner system houses two chain ratchets, "upper" and "lower". The ratchets have both the same orientation, to allow the chain to be lifted and taken out of the system in upward direction.

The ratchets are designed for the same operational loads. The function of the chain ratchets is to act in tandem with the reciprocating chain jacks as a hand-over-hand pulling system. A device is installed to hold the chain in position while the jacking cylinders are retracted (downward) for the next stroke upward (normal tensioning mode). Same applies for releasing of chain, however vice versa.

The chain ratchets are machined to match the profile of the chain and are activated by the double acting hydraulic cylinders. The ratchets automatically open and closes when pulling or lowering chain.

Each retract cylinder are provided with a flow control device on the chain jack to control the opening/closing of the ratchets. The hydraulic power supply for operating the upper and lower set of ratchets is obtained from the main HPU supply.

Counterbalance valve(s) or other safety systems are provided on the chain jack to prevent the jacking cylinders from lowering the load, or to open the ratchets, due to a loss of hydraulic pressure.

When pulling or lowering a chain towards or from the locker, the chain will enter the chain tensioner in horizontal position. In order to guarantee proper chain alignment in the ratchets, the chain is guided by a supporting device. Also inside the chain tensioner, in between the two ratchets, the chain has to be supported to guarantee the chains remain correctly positioned. There is pretension to be generated by the motorized chain wheel in order to guarantee proper pulling and lowering of the chain.

The frame of the chain tensioner systems functions as a base for the jacking cylinders, the lower chain ratchet and the chain wheel, in order to skid over the track, and to equally distribute the loads over the track foundation. Skidding pads are mounted below the frame When the chain tensioner is located in its correct position on the skid track, it is locked in position by application of locking pins on the frame, to be lowered into the rail profile.

Skidding System

The skidding system consist of an automatic hand over hand push and pull unit. It is equipped with 2 sets of hydraulic rail grippers (one set clamped while the other set is moving) and sliding pads to suit the skid rail. It has (manually) pinned connections at both ends to connect to the motorized chain wheel and to the chain tensioner system. The skid system can actuate 2 motions:

For the chain tensioner: It enables the chain tensioner skid frame to be skidded from one mooring chain position to the next over the complete length of the track (except above the chain locker). The push/pull unit only needs to transport the chain tensioner when the chain is unloaded.

For the Motorized Chain Wheel: It enables the motorized chain wheel frame to be skidded lengthwise above the chain locker, to be able to distribute the chain in the locker. Maximum horizontal load during skidding is for example 15 tons.

The chain tensioning system's components can be skidded over the skidding track. This track is to form one continuous skid track for all tensioning system's components: chain tensioner, skidding unit, and motorized chain wheel. There are 2 rails for each track (in total 8 rails).

The length of total skid track is as for example 35 m and material of rail is to be weldable steel. Mating pad materials and designs can be selected to suit the rail.

Purpose of rails is to facilitate skidding of chain tensioner from one mooring leg to the next. The chain tensioner is to be (manually) pin-locked above its mooring leg positions.

The rails also facilitate skidding of the motorized chain wheel above the chain locker in order to evenly distribute the chain in the locker. Both the motorized chain wheel skid and the skidding system itself are then "clamped" to the track only by grippers of the skidding system.

The rails also facilitate skidding of the motorized chain wheel 'towards the edge' of the porch in order to lower the chain to a supply boat. The motorized chain wheel is then to be (manually) pin-locked in this position. The rails are used for vertical support but also for horizontal guiding of the skids and for the skidding unit.

The skidding system is an easily manually pin-connected/disconnected at both ends to the chain tensioner skid and the motorized chain wheel skid.

When the chain tensioner skid and the motorized chain wheel skid are located in their correct working positions or in their sea-fastening positions, all skids are able to be manually pin-connected to the rail track, in order to withstand the vessel motions.

The main functions of motorized chain wheel are:

A Lift the chain from and into the locker. In order to properly distribute the chain into the chain locker, the motorized chain wheel is skidded above the locker by means of the skidding unit.

Skidding of the motorized wheel will as a base case occur while the motorized wheel is keeping the chain (catenary) running towards the chain tensioner under tension. The motorized chain wheel will also be used for lifting the chain dead weight from the locker, combined with "digging out" of buried chain lengths, and feeding this chain towards the chain tensioner.

B Provide pre-tension. The motorized chain wheel is used to guide the chain from the chain-locker in the direction of the chain tensioner and vice versa, when the chain is lifted or lowered via the chain tensioner system. The system is able to maintain the required pretension level. regardless of:

C Hand over the excess chain to a tugboat. The system shall be able to lift a length of excess chain (typically 60-80 m) from the chain locker and lower it towards a tugboat.

Auxiliary Winch

An auxiliary winch can mounted at the end of the skid track. The main functions are:

1 Chain handling towards the chain tensioner skid. The installation chain can lifted from the chain locker with the aid of an auxiliary winch, and pulled over the Retractable chain-support tables and through the chain tensioner, so that it can be spooled over the non-driven chain wheel. The installation chain will then be connected (at deck level) to a messenger chain, that is pre-installed through the I-tubes. Load on the auxiliary winch rope is created when pulling the chains, which are supported by the retractable chain-supports to avoid sagging. Total estimated pull load can be 15 ton.

2 To handover the excess chain to a tugboat. The motorized chain wheel will therefore be positioned at the end of the track. Pieces of 60-80 m length of excess chain will be lowered towards the tugboat. When nearly all chain is outboard, the auxiliary winch helps by pulling the chain when it leaves the motorized wheel. The auxiliary rope will then run from the auxiliary winch, via the motorized wheel, to the sea level, to be pulled in by the tugboat's winch. Onboard the tug, the rope will be released.

Local Control Panel

Each chain tensioner system may have a local (portable) control console: one console on each porch. Each control panel is required to control the chain tensioner including ratchets, the skidding system, the motorized wheel, the auxiliary winch and the appertaining HPU (one HPU for two clusters).

It will be apparent to the person skilled in the art that other embodiments of the invention can be conceived and reduced to practice without departing form the true spirit of the invention, the scope of the invention being limited only by the appended claims as finally granted. The description is not intended to limit the invention.

The invention claimed is:

1. A traction system (11; 60) for a number of operating lines (18) of a vessel (1), said vessel comprising at least two work stations (26) distributed along at least two sides of the vessel (1) and engaged by respective operating lines (18), wherein the traction system (11; 60) is adapted for providing traction for the operating lines which engage one workstation of said at least two workstations and comprises:

a main traction device (14; 15, 17; 15A, 17);

a transmission device (36) having a duty line (28) connected to the main traction device (14; 15, 17);

a guide member (24) for selectively routing the duty line (28) to said one work station (26) for attachment to a respective operating line (18) which engages said one workstation;

a line storing space (22; 42, 44) for storing at least one of the group consisting of parts of the duty line (28) and hauled-in operating lines (18), wherein said traction system, including the main traction device (14; 15, 17; 15A, 17), the transmission device (36), and the line storing space (22; 42, 44), are placed at or near the side of the vessel where said one workstation is arranged, wherein said transmission device (36) is arranged at a side of the line storing space and is adapted for transmitting the duty line (28) to and from the line storing space; and a track (30) placed along said side of the vessel, wherein one of the group consisting of said guide member (24) and said main traction device (14; 15, 17; 15A) is moveable over said track (30) relative to said transmission device (36) and said line storing space (22; 42,44).

2. The traction system (11; 60) according to claim 1, wherein the main traction device (14; 15, 17; 15A, 17) is placed between the line storing space (22; 42; 44) and the workstation (26) to which the main traction device (14; 15, 17; 15A, 17) is connected in operation.

3. The traction system (11; 60) according to claim 1, wherein the guide member (24) is moveable over said track (30) placed along said side of the vessel (1).

4. The traction system (11; 60) according to claim 1, wherein the main traction device (14; 15, 17; 15A, 17) is moveable over said track (30) placed along said side of the vessel (1).

5. The traction system (11; 60) according to claim 1, wherein the main traction device (14; 15, 17; 15A, 17) is moveable over said track (30), and said track (30) leads over the workstation (26).

6. The traction system (11; 60) according to claim 5, wherein the workstation comprises a number of fairleads (38) for guiding a respective one of said operating lines (18) which engage said workstation, each fairlead having an upper end opening (40);

the main traction device (14; 15, 17; 15A, 17) being moveable over the track (30) to a position above the upper end opening (40) of a selected fairlead (38) in the workstation (26).

7. The traction system (11; 60) according to claim 1, wherein the track is substantially parallel to the side of the vessel.

8. The traction system (11; 60) according to claim 1, wherein the workstation (26) comprises at least two fairleads (38) each capable of receiving and holding an operating line (18).

9. The traction system (11; 60) according to claim 1, wherein the duty line is a chain.

10. The traction system (11; 60) according to claim 1, wherein the main traction device (14) is chain jack skid capable of horizontal pulling.

11. The traction system (11; 60) according to claim 1, wherein the main traction device (14) is chain jack skid capable of vertical pulling.

12. The traction system according to claim 1, wherein the line storing space (22; 42, 44) is an extension at the side of the vessel.

13. The traction system according to claim 1, wherein the workstation (26) is an extension at the side of the vessel.

14. The traction system according to claim 1, wherein the main traction device (11; 60), the workstation (26) and the line storing space (22; 42, 44) are combined in one module (60) to facilitate a quick integration of the workstation (26) and the line storing space (22; 42, 44) into the vessel.

15. The traction system according to claim 14, wherein the module (60) of the traction system is arranged to be mounted on and fixed to the vessel (1).

16. The traction system (11; 60) according to claim 1, wherein the line storing space comprises at least one of a chain locker space (22) and a hang-off balcony (42, 44).

17. The traction system according to claim 16, wherein the hang-off balcony is located outside of the vessel's hull above water (50) and is provided with means for attaching an end of the line and for hanging off the attached line in one or more loops thus configuring the balcony for storing the line.

18. A chain jack skid adapted for use in a traction system according to claim 1.

19. A method for hauling-in operating lines (18) with a traction system (11; 60) according to claim 1, comprising the steps of:

connecting the duty line (28) via the workstation (26) to an operating line (18);

activating the main traction device (11; 60) to haul-in the operating line through the workstation;

guiding (24; 17) and storing (22; 42, 44) the part of the duty line and/or operating line that is hauled-in into the line storing space;

securing the operating line to the workstation;

disconnecting the duty line from the operating line;

guiding and connecting the duty line via the workstation to a next operating line, comprising moving one of the group consisting of said main traction device and said guide member relative to said transmission device and said line storing space; and repeating said steps.

20. A traction system (11; 60) in combination with a vessel, wherein the vessel (1) comprises plural operating lines (18), and at least two work stations (26) distributed along at least two sides of the vessel (1), the operating lines engaging one workstation (26) of said at least two workstations, and wherein the traction system (11;60) is adapted for providing traction for the operating lines which engage the one workstation, the traction system (11;60) comprising:

a main traction device (14; 15, 17; 15A, 17);

a transmission device (36) having a duty line (28) connected to the main traction device (14; 15, 17);

a guide member (24) that selectively routes the duty line (28) to said one work station (26) for attachment to a respective operating line (18) which engages said one workstation;

a line storing space (22; 42, 44) that stores parts of at least one of the group consisting of the duty line (28) and hauled-in operating lines (18), wherein the main traction device (14; 15, 17; 15A, 17), the transmission device (36), and the line storing space (22; 42, 44), are placed at the side of the vessel where said one workstation is arranged, wherein said transmission device (36) is arranged at a side of the line storing space and is adapted for transmitting the duty line (28) to and from the line storing space; and a track (30) placed along said side of the vessel, wherein one of the group consisting of said guide member (24) and said main traction device (14; 15, 17; 15A) is moveable over said track (30) relative to said transmission device (36) and said line storing space (22; 42,44).

* * * * *